United States Patent [19]

Seragnoli

[11] 4,431,010

[45] Feb. 14, 1984

[54] CIGARETTE FILTERS APPLYING DEVICES

[75] Inventor: Enzo Seragnoli, Bologna, Italy

[73] Assignee: G. D Società per Azioni, Bologna, Italy

[21] Appl. No.: 272,759

[22] Filed: Jun. 11, 1981

[30] Foreign Application Priority Data

Jun. 20, 1980 [IT] Italy ..... 49022 A/80

[51] Int. Cl.[3] ..... A24C 5/47

[52] U.S. Cl. ..... 131/94; 131/88

[58] Field of Search ..... 131/94, 95, 27, 27 A, 131/29, 32, 36, 28, 105, 30, 36, 39, 61 A, 66 A, 88

[56] References Cited

U.S. PATENT DOCUMENTS 3,380,459 4/1968 Schmerund ..... 131/94

3,473,536 10/1969 Oesterling et al. ..... 131/94

4,095,606 6/1978 Frandsen ..... 131/105

*Primary Examiner*—V. Millin

*Attorney, Agent, or Firm*—Fitzpatrick, Cella, Harper & Scinto

[57] ABSTRACT

The device for applying cigarette filters by use of glued junction hands is of the conventional type and comprises a rotating main drum for receiving on grooves provided on its cylindrical surface a plurality of units disposed in parallel arrangement with the axis of said drum. Each unit, formed by one cigarette, a filter section and by another cigarette coaxially disposed, is wrapped up by a band of adhesive paper material covering said filter section and about $\frac{1}{8}''$ of the end sections of the two cigarettes. The rolling operation of the band is carried out within a rolling passage defined at one side by said main drum and at the other side by a web slidingly guided along a curved surface concentric with the main drum.

The improvements according to the invention provide means for retaining said web adhering to said guide and sliding surface, said means being of magnetic or suction type.

6 Claims, 3 Drawing Figures

CIGARETTE FILTERS APPLYING DEVICES

BACKGROUND OF THE INVENTION

The present invention relates to improvements in or relating to cigarette filters applying devices of the type in which cigarettes and filters are interconnected by adhesive junction bands.

It is already known to apply the filters to cigarettes by disposing the cigarettes in a two by two axial arrangement with a filter having a length twice of that required for a single cigarette therebetween disposed and by wrapping up a band of adhesive paper material to cover the full length of the filter section plus about ⅛" of the end section of the two cigarettes coaxial with said filter section.

The complex formed by one cigarette, by the filter section and by the other cigarette in axial relationship is thereinafter called "unit".

The steps above mentioned are usually carried out, for example, as described in the Italian Pat. No. 898,079 in the name of Hauni Werke Korker and Co. KG (priority of the German application No. 1911102.5 of Mar. 5, 1969), on the surface of a conveyor drum, to which said units and adhesive bands are supplied. The elements making each unit are interconnected by a rolling operation on an adhesive band.

Such a rolling operation is carried out within a rolling passage defined at one side by said drum and at the other side by a web moving at a different speed than that of the drum. Such a web, usually made of rubber or steel foil, is kept substantially equispaced relative to the surface of said drum by the units in said passage. During the rolling operation the units are subjected to compression by the web, which compression promotes the correct and tight wrapping of the bands.

The devices of the above described type have some drawbacks which comprise the regular operation thereof, particularly under certain conditions.

It has been found, for example, that said web exerts on the units a compressive action which is unsteady during the course of the entire rolling operation. This results in uneveness in the adherence of the wrapped up bands to the units. Serious drawbacks also arise in case where one or more consecutive units are absent at the rolling zone. In such a case, where units are frequently absent due to the rejection of units found as defective or incomplete upstream of the rolling zone, there is a shifting of a portion of the web from the condition of substantial concentric disposition with the conveyor drum, which results in a larger compression exerted on the units within said passage.

Particularly detrimental consequences occur in the case in which, due to the absence of a plurality of consecutive units, the web would come in contact with said conveyor drum.

SUMMARY OF THE INVENTION

It is the object of the present invention to provide an improved device of the above mentioned type which embodies the advantages but avoids the drawbacks of the conventional devices.

The improved cigarette filters applying device, according to the invention, is of the type comprising a rotating drum for receiving on its cylindrical surface a plurality of units disposed in parallel arrangement with its axis, a movable continuous web defining in combination with said drum a rolling passage of about the same width as that of the diameter of said units, a counteracting element defining at said rolling passage a guide and sliding surface for said web, coaxial with said drum and is characterized in that it comprises at said rolling passage retaining means for retaining said web on said guide and sliding surface.

The novel features which are considered as characteristic of the invention are set forth in particular in the appended claims. The improved device itself, however, both as to its construction and its mode of operation, together with additional features and advantages thereof, will be best understood by the following detailed description of certain specific embodiments with reference to the accompanying drawings.

DESCRIPTION OF THE PREFERRED EMBODIMENTS

Figure 1:
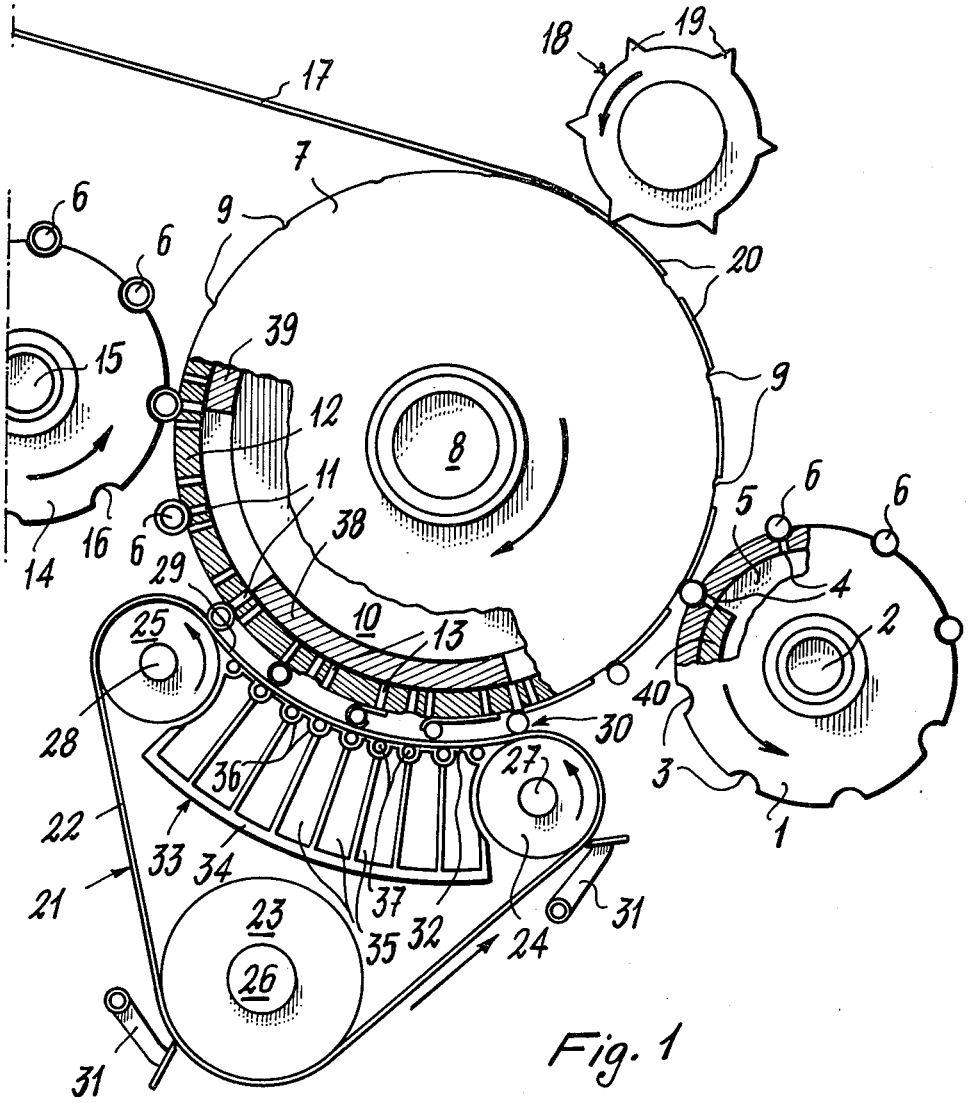
FIG. 1 is a diagrammatic front and partly sectional view showing a first embodiment of the device according to the present invention.

Referring to FIG. 1, reference numeral 1 designates a first drum having horizontal axis, carried by a shaft 2 and rotatably driven by means (not shown) in counterclockwise direction. Such a drum 1 is provided with a peripheral surface having equally spaced grooves 3 therein.

The bottom of each groove 3 communicates through holes 4 with a cylindrical cavity or chamber 5 within drum 1, which in turn is connected in a manner not shown in FIG. 1, with a suction source, not shown.

Said grooves 3 can accommodate units designated as a whole by 6, each comprising—as above described—two cigarettes with the interposition of a filter section of twice a length relative to the filter to be applied to a single cigarette.

Adjacent said first drum 1, at the left side thereof in FIG. 1, there is a main drum 7 carried by a shaft 8 parallel with shaft 2 and peripherally provided with grooves 9.

The main drum 7 rotates in a clockwise direction with the same peripheral speed as that of the first drum 1, successively conjugating its grooves 9 with grooves 3, and internally has a cylindrical chamber 10 connected in a manner not shown to a suction source, also not shown.

Said grooves 9 communicate with chamber 10 through holes 11 passing through the cylindrical wall 12 of drum 7; holes 13 also pass through the wall 12 between each pair of grooves 9.

Reference numeral 14 designates a second drum carried by a shaft 15 parallel with shaft 8.

The drum 14 is peripherally provided with grooves 16 and rotates in a counterclockwise direction with the same peripheral speed as that of main drum 7, successively conjugating its grooves 16 with grooves 9.

Means, not shown, tangentially feed on the periphery of the main drum 7 a web 17 of paper material glued on the upper side from a roll, not shown in FIG. 1, at a feed speed lower than the peripheral speed of said drum 7.

The portion of said web 17 contacting the main drum 7 is kept adhering thereto by the suction effect exerted through holes 13.

A rotating cutting means 18, provided with six equally spaced peripheral blades 19, is disposed upstream of the contiguity zone between drums 1 and 7 and is so arranged to act on the periphery of drum 7.

Cutting means 18 is rotatably, in a counterclockwise direction, and sequentially separates from said web 17 a number of bands 20 intended for interconnection of the elements forming the units 6.

Due to the above mentioned difference between the peripheral speed of main drum 7 and the linear speed of web 17, the leading edge of said web constantly slips on the drum 7, so that after each cutting the various bands 20 will adhere to drum 7 conveniently spaced apart from one another.

A rolling means, designated as a whole at 21, is operative between drums 1 and 14 adjacent said drum 7. This rolling means comprises a web 22 of flexible type and made of ferromagnetic material, such as steel foil, which is ring-like wound about three rollers 23, 24 and 25, which are carried on shafts 26, 27 and 28, respectively, parallel with said shaft 8 and arranged according to the apices of a triangle.

While roller 23, idly mounted on shaft 26, is a simple transmission element for web 22, the two rollers 24 and 25, rotatably driven in a counterclockwise direction by drive means, not shown, provide for driving said web 22 at a lower speed than the peripheral speed of the main drum 7.

The web section 29 comprised between the rollers 24 and 25 and the opposed portion of drum 7 define a rolling passage 30 for units 6.

Conventional scraper elements 31 are operative on said web 22 at said rollers 23 and 24, and constantly assure the cleaning thereof.

Along said rolling passage 30, the section 29 adheres to a guide and sliding surface 32 concave and coaxial with drum 7. Said surface 32 is defined by a counteracting element 33 comprising a support element 34 for supporting a plurality of juxtaposed permanent magnets 35 radially directed to the axis of roller 7 and adjacent at one end to the section 29 of web 22 in said rolling passage 30.

Each of said one end of magnets 35 is laterally provided with bevels 36 of such a shape and size as to accommodate small idler rollers 37, parallel with shaft 8 and carried in a manner not shown, for preventing said web 22 from directly contacting said magnets 35.

As shown in FIG. 1, suction on the surface of the main drum 7 through the holes 11 and 13 is prevented at said rolling zone 30 and immediately downstream of the contiguity zone between drums 7 and 14 by the provision in the chamber 10 of respective stationery arcuate walls 38 and 39, coaxial with drum 7 and adjacent to the inner surface of the cylindrical wall 12 at such zones.

Similarly, an arcuate wall 40 in drum 1 will undo the sucking action through the grooves 3 starting from the contiguity zone of said drum 1 and drum 7.

In operation, the units 6 are sequentially transferred from the grooves 3 of drum 1 to the grooves 9 of drum 7, and are retained by the latter owing to the suction effect exerted through the holes 11.

After being separated from the web 17 by the cutting means 18, the bands 20 adhere to the main drum 7 due to the sucking effect exerted through holes 13. Each band is disposed between two successive grooves 9 and has the leading edge, with respect to the rotating direction of the drum 7, thereof close to the downstream groove 9.

Upon reaching the rolling zone 30, the units 6 come in contact with the web 22 and, due to the lower feed speed of the latter relative to the peripheral speed of main drum 7, start to roll on the relative bands 20 wrapping thereabout and connecting the elements forming each unit.

During such a rolling operation, each unit 6 moves out of the respective groove 9 and then re-enters a successive groove 9 at the end of the rolling operation.

In order that said units 6 can move out of said grooves 9 without any damage, said grooves 9 are of very reduced depth.

Following the rolling operation, the units 6 reach the drum 14, are conventionally retained within the grooves 16 and carried thereby to successive processing stations, not shown.

According to a significant feature of the present invention, the web 22 is maintained at said rolling zone 30 adhering to the guide and sliding surface 32 owing to the action exerted thereon by the magnets 35.

Accordingly the compression to which said units 6 are subjected as said bands 20 are wrapped up remains steady during the full rolling operation.

Moreover, the device according to the invention does not have any of the above described drawbacks resulting from the absence of one or more consecutive units 6.

If desired, the web 22 could be kept adhering to the guide and sliding surface 32 by providing electromagnets instead of said magnets 35.

Figure 2:
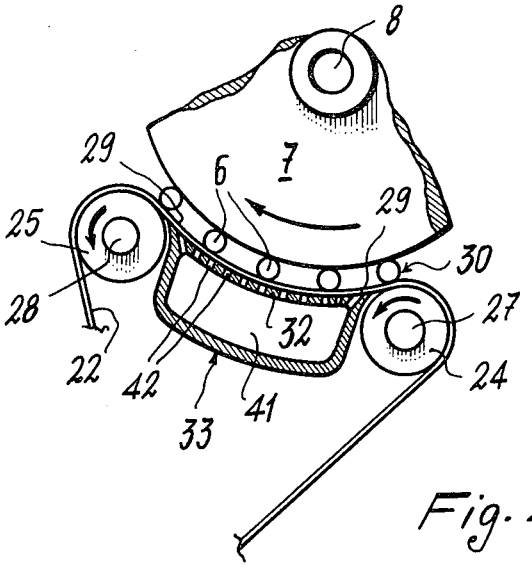
FIG. 2 is a view showing another embodiment of the embodiment of FIG. 1.

According to another embodiment of the invention, shown in FIG. 2, the guide and sliding surface 32 is internally provided with a chamber 41 connected with suction means, not shown.

The chamber 41 communicates with the web 22 through holes 42 in the surface 32 of the counteracting element 33 at the opposite side to said rolling zone 30. The section 29 of web 22 adheres to said surface 32 owing to the suction effect exerted thereon through said holes 42.

Figure 3:
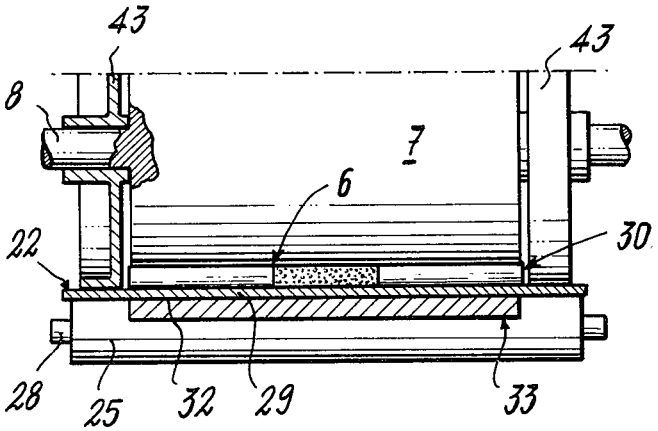
FIG. 3 is a diagrammatic side and partly sectional view showing a third embodiment of the device according to the present invention.

In a further embodiment of the device according to the invention, shown in FIG. 3, the desired spacing of the web section 29 from the main drum 7 at said rolling zone 30 is provided by making said web 22 wider than the drum 7, and by an idle or driven disc 43 of suitably larger diameter which disc coaxially approaches each side of the drum, with each disc peripherally bearing on the corresponding edge of web 22 to define the distance or spacing from the drum 7.

The counteracting element 33 could be provided without said small rollers 37, and its surface contacting the web 22 could be made, as not to jeopardize the action of magnets 35, with material of low coefficient of friction.

Finally, instead of being made of ferromagnetic metal material, the web 22 could be made of rubber or synthetic material comprising portions of ferromagnetic material.

Without further analysis, the foregoing will so fully reveal the gist of the present invention that others can, by applying current knowledge, readily adapt it for various applications without omitting features which fairly constitute essential characteristics of the generic and specific aspects of my contribution to the art and, therefore, such adaptations should and are intended to be comprehended within the meaning and range of equivalence to the claims.

What I claim is:

1. In a cigarettes filters applying device comprising a main rotating drum for receiving on its cylindrical surface a plurality of units disposed in parallel arrangement with the axis of said drum; at least a pair of rollers positioned adjacent to said drum and having axes parallel to the axis of said drum; a movable continuous web mounted around said rollers so that a section of said web between said rollers faces said drum defining in combination with said drum a rolling passage of about the same width as the diameter of said units; a counteracting element disposed between said rollers on the side of said section of said web opposite to said rolling passage and defining at said rolling passage a concave guide and sliding surface for said web, coaxial with said drum, said guide and sliding surface being constructed of a material having a low coefficient of friction; the improvement residing in that retaining means are provided in association with said counteracting element but separated from said web section for adheringly retaining said web section to said guide and sliding surface.

2. In a cigarette filters applying device comprising a main rotating drum for receiving on its cylindrical surface a plurality of units disposed in parallel arrangement with the axis of said drum; at least a pair of rollers positioned adjacent to said drum and having axes parallel to the axis of said drum; a movable continuous web mounted around said rollers so that a section of said web between said rollers faces said drum defining in combination with said drum a rolling passage of about the same width as the diameter of said units; a counteracting element disposed between said rollers on the side of said section of said web opposite to said rolling passage and defining at said rolling passage a concave guide and sliding surface for said web, coaxial with said drum; the improvement residing in that retaining means are provided for adheringly retaining said web section to said guide and sliding surface, wherein said retaining means includes magnetic means carried by said counteracting element along said guide and sliding surface and facing the side of said web opposite to that defining said rolling passage, and said web is constructed of ferromagnetic material.

3. In a cigarette filters applying device comprising a main rotating drum for receiving on its cylindrical surface a plurality of units disposed in parallel arrangement with the axis of said drum; at least a pair of rollers positioned adjacent to said drum and having axes parallel to the axis of said drum; a movable continuous web mounted around said rollers so that a section of said web between said rollers faces said drum defining in combination with said drum a rolling passage of about the same width as the diameter of said units; a counteracting element disposed between said rollers on the side of said section of said web opposite to said rolling passage and defining at said rolling passage a concave guide and sliding surface for said web, coaxial with said drum; the improvement residing in that retaining means are provided for adheringly retaining said web section to said guide and sliding surface, wherein said retaining means includes magnetic means carried by said counteracting element along said guide and sliding surface and facing the side of said web opposite to that defining said rolling passage, and said web is comprised of portions of ferromagnetic material.

4. In a cigarette filters applying device comprising a main rotating drum for receiving on its cylindrical surface a plurality of units disposed in parallel arrangement with the axis of said drum; at least a pair of rollers positioned adjacent to said drum and having axes parallel to the axis of said drum; a movable continuous web mounted around said rollers so that a section of said web between said rollers faces said drum defining in combination with said drum a rolling passage of about the same width as the diameter of said units; a counteracting element disposed between said rollers on the side of said section of said web opposite to said rolling passage and defining at said rolling passage a concave guide and sliding surface for said web, coaxial with said drum; the improvement residing in that retaining means are provided for adheringly retaining said web section to said guide and sliding surface, wherein said retaining means includes suction means communicating with said guide and sliding surface, said suction means facing the side of said web opposite to that defining said rolling passage.

5. In a cigarette filters applying device comprising a main rotating drum for receiving on its cylindrical surface a plurality of units disposed in parallel arrangment with the axis of said drum; at least a pair of rollers positioned adjacent to said drum and having axes parallel to the axis of said drum; a movable continuous web mountd around said rollers so that a section of said web between said rollers faces said drum defining in combination with said drum a rolling passage of about the same width as the diameter of said units; a counteracting element disposed between said rollers on the side of said section of said web opposite to said rolling passage and defining at said rolling passage a concave guide and sliding surface for said web, coaxial with said drum; the improvement residing in that retaining means are provided for adheringly retaining said web section to said guide and sliding surface and rolling elements are interposed between said guide and sliding surface and said web, said rolling elements being carried by said counteracting element.

6. An improved cigarette filters applying device which comprises:

a main rotating drum for receiving on its cylindrical surface a plurality of units disposed in parallel arrangement with the axis of said drum;

at least a pair of rollers mounted adjacent to said drum and having axes parallel to the axis of said drum;

a movable continuous web mounted around said rollers to form, in the area between said rollers, a section defining with said drum a rolling passage of about the same width as the diameter of said units, said web having a width greater than the width of said drum; and a pair of discs, each coaxially mounted adjacent to a side of said drum, said discs having a diameter greater than the diameter of said drum and being mounted to peripherally bear on the edges of said web to maintain said web section defining said rolling passage at a spacing from said drum of about the diameter of said units.

* * * * *

UNITED STATES PATENT AND TRADEMARK OFFICE

CERTIFICATE OF CORRECTION

PATENT NO. : 4,431,010

DATED : February 14, 1984

INVENTOR(S) : ENZO SERAGNOLI

It is certified that error appears in the above-identified patent and that said Letters Patent is hereby corrected as shown below:

Column 6, line 30, change "mountd" to -- mounted --.

Signed and Sealed this

*Nineteenth* Day of *June 1984*

[SEAL]

*Attest:*

*Attesting Officer*

GERALD J. MOSSINGHOFF

*Commissioner of Patents and Trademarks*